US007402798B2

(12) United States Patent
Staats

(10) Patent No.: US 7,402,798 B2
(45) Date of Patent: Jul. 22, 2008

(54) APPARATUS AND METHOD FOR CONTROLLING AN ELECTROSTATICALLY INDUCED LIQUID SPRAY

(75) Inventor: Sau Lan Tang Staats, Hockessin, DE (US)

(73) Assignee: Phoenix S&T, Inc., Chester, PA (US)

( * ) Notice: Subject to any disclaimer, the term of this patent is extended or adjusted under 35 U.S.C. 154(b) by 195 days.

(21) Appl. No.: 11/329,508

(22) Filed: Jan. 10, 2006

(65) Prior Publication Data

US 2008/0006769 A1 Jan. 10, 2008

Related U.S. Application Data

(60) Provisional application No. 60/645,165, filed on Jan. 18, 2005.

(51) Int. Cl.
*H01J 49/10* (2006.01)
*H01J 49/00* (2006.01)

(52) U.S. Cl. ..... 250/288; 250/428; 239/3; 239/690; 361/227; 361/228

(58) Field of Classification Search ..... 250/288
See application file for complete search history.

(56) References Cited

U.S. PATENT DOCUMENTS 4,398,671 A * 8/1983 Coffee ..... 239/690
4,467,961 A * 8/1984 Coffee et al. ..... 239/1
4,797,820 A * 1/1989 Wilson et al. ..... 700/284
5,218,305 A * 6/1993 Lunzer ..... 324/457
5,349,186 A * 9/1994 Ikonomou et al. ..... 250/288
5,489,929 A * 2/1996 Vago ..... 347/55
5,647,542 A * 7/1997 Diana ..... 239/690
5,663,560 A * 9/1997 Sakairi et al. ..... 250/281
5,917,184 A * 6/1999 Carson et al. ..... 250/288
6,326,062 B1 * 12/2001 Noakes et al. ..... 427/475
6,627,166 B1 * 9/2003 Simon ..... 423/210
7,193,124 B2 * 3/2007 Coffee ..... 602/48
2003/0205631 A1 * 11/2003 Barron et al. ..... 239/690
2006/0103051 A1 * 5/2006 Staats ..... 264/297.2
2008/0006769 A1 * 1/2008 Staats ..... 250/288

* cited by examiner

*Primary Examiner*—David A. Vanore
*Assistant Examiner*—Bernard Souw
(74) *Attorney, Agent, or Firm*—Leason Ellis LLP

(57) ABSTRACT

A system for controlling an electrostatically induced liquid spray includes an electrostatic spray device for generating a liquid spray from a liquid sample; a spray current sensing means placed in relation to the spray device and configured to generate a current output signal that represents a current of the liquid spray; and a mechanism that receives the current output signal and compares it to a pre-selected current value, with a difference between the two representing a control signal that is sent to one of (1) a pump that regulates the flow rate of the liquid sample and (2) a power supply to regulate an electric field associated with the spray device that generates the liquid spray according to a set level of current.

11 Claims, 5 Drawing Sheets

APPARATUS AND METHOD FOR CONTROLLING AN ELECTROSTATICALLY INDUCED LIQUID SPRAY

CROSS-REFERENCE TO RELATED APPLICATION

The present application claims the benefit of U.S. patent application Ser. No. 60/645,165, filed Jan. 18, 2005, which is hereby incorporated by reference in its entirety.

TECHNICAL FIELD

The present application relates to an apparatus and methods that improve the performance of spraying a liquid through a nozzle opening solely by means of an electric field.

BACKGROUND

One type of liquid spraying is known as Nan-electro spray or nanospray when used as a sample introduction method in mass spectrometry. The sources of generating such a spray may be quartz or glass capillaries tapered to a tip having a predetermined diameter, or they can be microfabricated nozzles made of silicon or other semiconductor or glass, etc. A liquid spraying apparatus can include the spray nozzle and a mechanism for pumping liquid through the nozzle, as well as a high voltage power supply for supplying the electric field for generating the spray.

SUMMARY

The sources of generating a liquid spray may be a quartz or glass capillaries tapered to a tip of a few microns to 10's of microns in diameter, microfabricated nozzles made of silicon or other semiconductor or glass, or injection-molded nozzles with a nozzle opening of ~20 microns. The apparatus consists of a spray nozzle and the mechanism for pumping liquid through the nozzle, a high voltage power supply for supplying the electric field for spraying, an electric current sensing means in the vicinity of the nozzle, and a negative feedback loop mechanism provided by an electronic circuit or a software program that inputs the current generated by the spray and outputs a signal to either the pumping mechanism or the voltage power supply to regulate the flow rate of the liquid sample or the electric field for spraying, respectively, according to a set level of current. With this apparatus, flow rate of the liquid sample from the nozzle opening can be accurately controlled.

Problems such as sample overshoot at the beginning of a spray, flow interruption due to extraneous factors such as air bubbles in the liquid sample, or surface tension changes due to changes in the chemical composition of the sample can be effectively eliminated. If an array of spraying nozzle is used, each spraying nozzle may be assigned a different set current according to the need of the experiment. Another important application of the invention is that the pumping speed of the sample liquid through the nozzle can be varied in a controlled fashion so that the pump speed can be substantially faster at the beginning when the sample liquid is going through the "dead volume" in the channel leading to the nozzle opening, thereby shortening the wait time between samples. This has particular utilization when the nozzles are in an array format and many samples are sprayed from individual nozzles sequentially.

BRIEF DESCRIPTION OF THE DRAWING FIGURES

The present invention will be understood and appreciated more fully from the following detailed description of preferred embodiments of the present invention, taken in conjunction with the following drawings in which.

DESCRIPTION OF PREFERRED EMBODIMENTS

Figure 1:
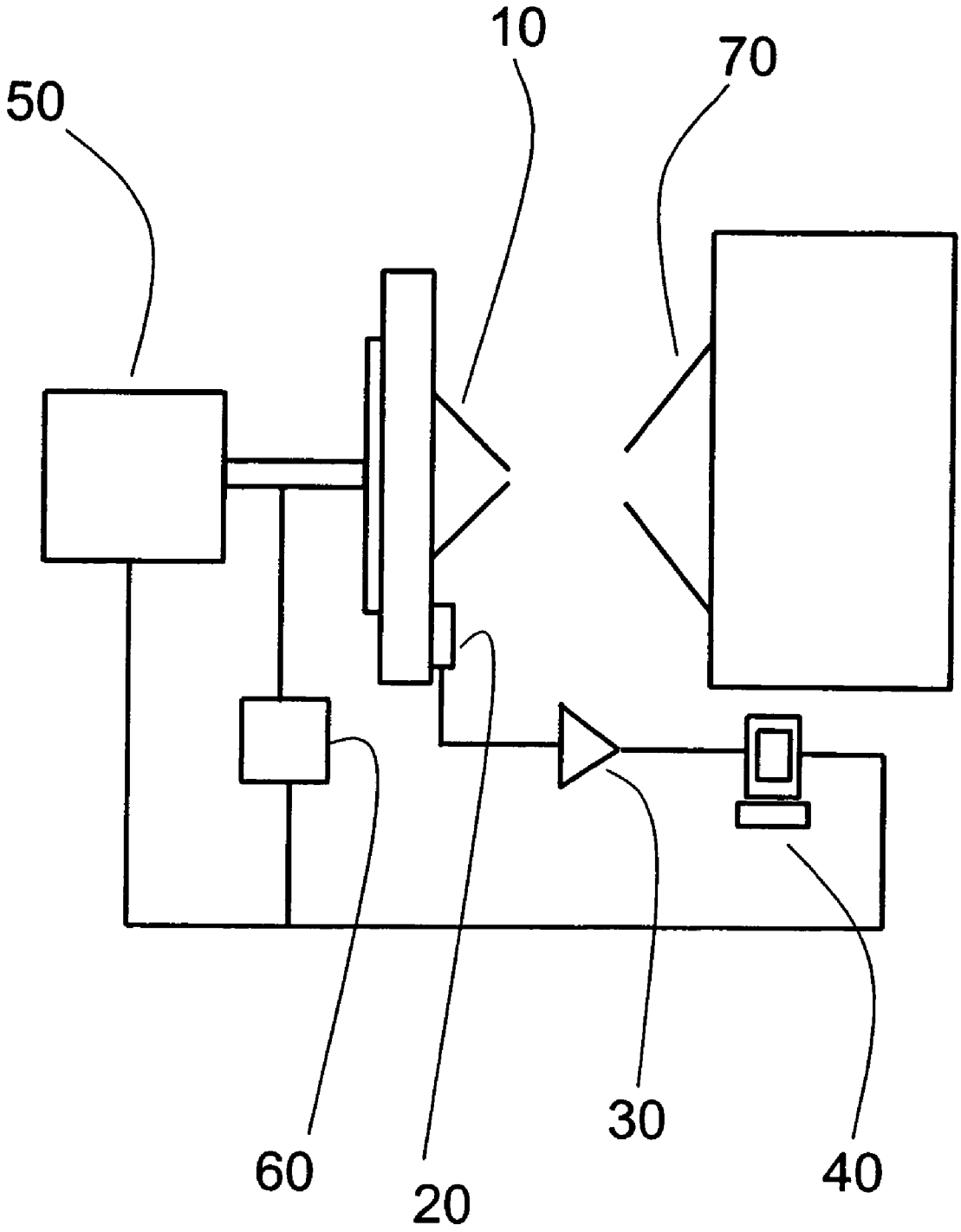
FIG. 1 is a schematic view of an apparatus for spray control according to a first embodiment, with a current sensing element disposed behind but in the vicinity of a spray nozzle device.

Referring to FIG. 1, the present invention consists of an electrostatic spray device 10 (e.g., a spray nozzle), a spray current sensing means, 20, which is placed in the vicinity of the spray device 10 and is connected to a current amplifier 30 and a negative feedback mechanism 40. The negative feedback mechanism 40 is configured to take the output from the spray current sensing means 20 and compares it to a pre-set reading of the current. The difference of the two is sent as a signal to regulate a pumping mechanism 50 (pump) or a programmable voltage power supply 60. The so regulated spray is input into the mass spectrometer inlet 70 that is disposed in an axial relationship with respect to the spray device 10 as shown. In other words, the openings of the spray nozzle 10 and the mass spectrometer inlet 70 are axially aligned with respect to one another.

In one embodiment, as exemplified in FIG. 1, the current sensing means 20 can be an electrode placed close to but behind the opening of the nozzle (spray device 10). In another embodiment, the sensing device 20 is an electrical conducting element placed from a millimeter to up to several cm in front of the spray nozzle device 10. The requirement on the design of the current sensing element 20 is that it does not physically obstruct the spray discharged from device 10 from entering the mass spectrometer inlet 70.

Figure 2:
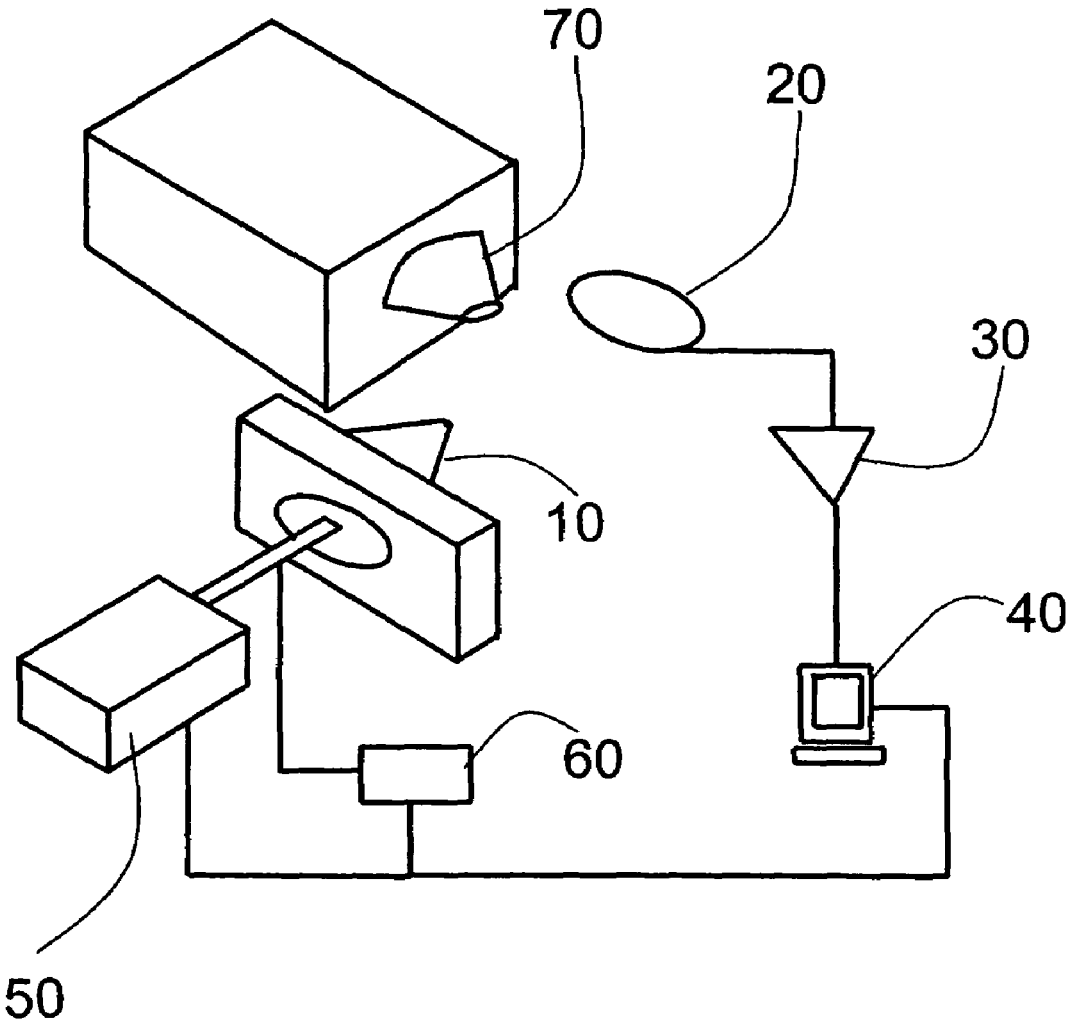
FIG. 2 is a schematic view of an apparatus for spray control according to a second embodiment, with a current sensing element disposed in front of a spray nozzle device that is placed perpendicular to a mass spectrometer inlet.

In FIG. 2, the spray nozzle 10 is positioned perpendicular to the inlet 70 of the mass spectrometer and the current sensing device 20 is placed directly in front of the nozzle 10 and beyond the mass spectrometer inlet 70 so as not to interfere with the reception of the spray in the inlet 70.

Figure 3:
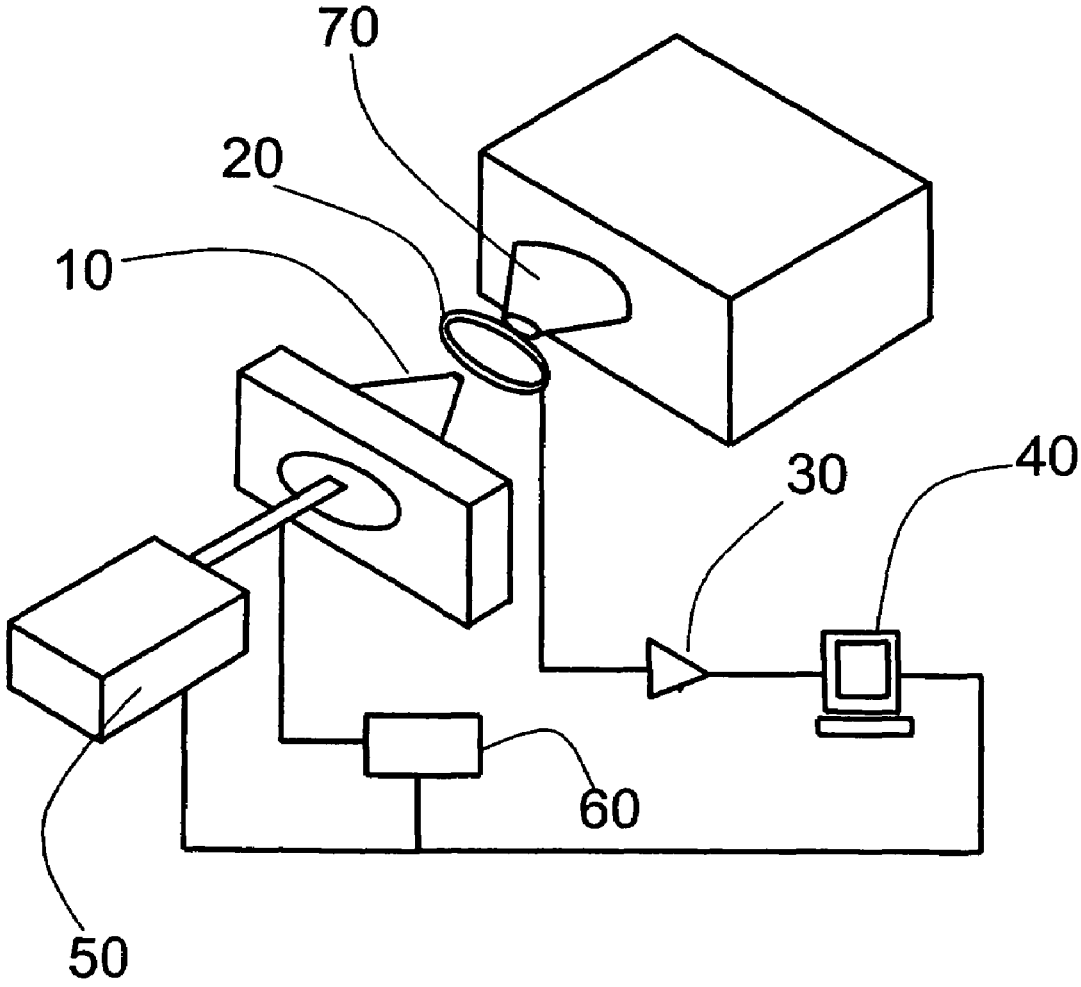
FIG. 3 is a schematic view of an apparatus for spray control according to a third embodiment, with a current sensing element disposed between a spray nozzle device and a mass spectrometer inlet.

In FIG. 3, the current sensing device 20 is placed between the spray nozzle 10 and the mass spectrometer inlet 70, and the current device 20 has an orifice that allows the spray to enter the mass spectrometer inlet 70 without physical obstruction.

Figure 4:
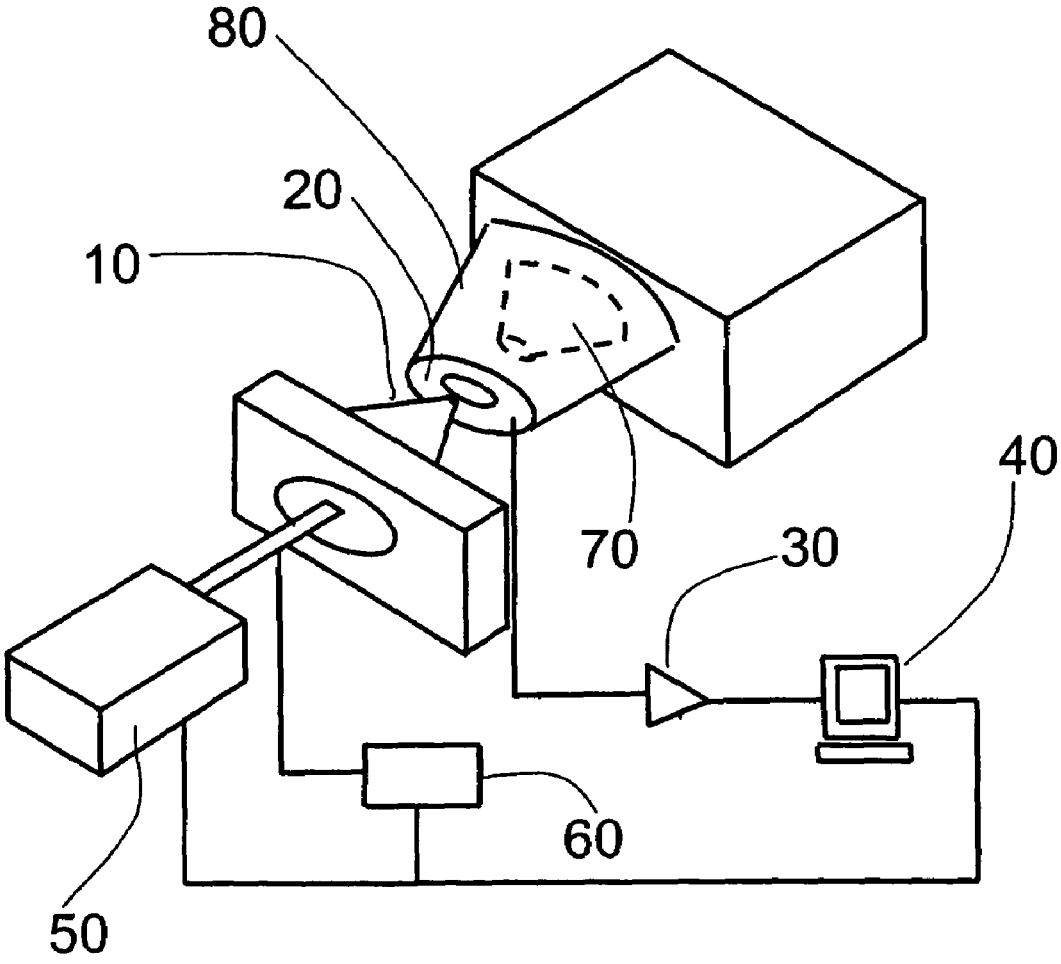
FIG. 4 is a schematic view of an apparatus for spray control according to a fourth embodiment, with a current sensing element enclosing a mass spectrometer inlet.
Figure 5:
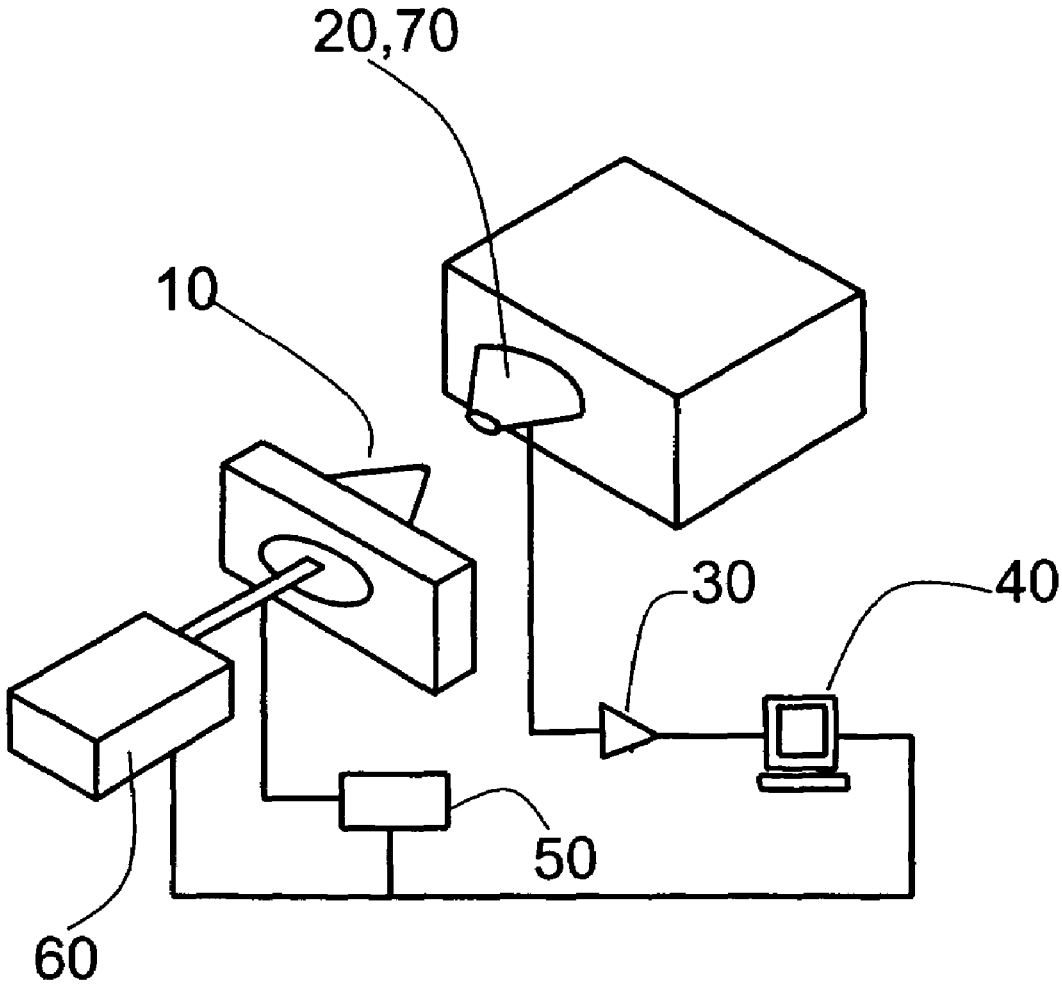
FIG. 5 is side schematic view of an apparatus for spray control according to a fifth embodiment, with a current sensing element incorporated into the design of a mass spectrometer inlet.

In yet another embodiment of the invention, the current sensing device 20 is a part of an enclosure 80 that surrounds the mass spectrometer inlet 70 but is electrically isolated from the mass spectrometer inlet 70, as schematically depicted in FIG. 4. The enclosure 80 acts as an electrical lens that focuses the spray from the nozzle 10 into the mass spectrometer inlet 70. In still another embodiment, the current sensing device 20 can be a part of the mass spectrometer inlet 70 as shown in FIG. 5.

To use the apparatus to regulate a spray, a liquid sample typically consists of a volatile organic liquid and water stored in a reservoir which may or may not be attached to the spraying nozzle, is pumped by means of an air or hydraulic pressure through the nozzle opening which is typically from a few microns to over 20 microns in diameter while a high voltage from abut 1 KV to several KV is applied to the nozzle tip or the liquid sample. A conical spray of the liquid sample into a fine mist results beyond the nozzle opening. Such a spray consists of many electrically charged droplets and ions, which when collected by the current sensing element, and input into a current amplifier, forms a measurable current typically from a few nanoamperes to 10's of microamperes, depending on the concentration of charged particles in the liquid sample, the ionization efficiency of the liquid sample under the electric field at the nozzle, the flow rate of the sample liquid through the nozzle, and the applied high voltage.

The dependence of the current over certain ranges of flow rates and applied voltage may be assumed to be more or less linear. Within these ranges where the dependence appears to be linear, the collected current is fairly stable at any fixed flow rate and applied voltage for a given liquid sample and nozzle geometry. When this current is larger in magnitude than that of a set reference current, the difference of the measured current and the set reference current creates a signal to the controller of the pump pumping the sample liquid through the nozzle to slow down or even reverse the pump direction. This change in the pumping action will reduce the flow rate of the liquid sample through the nozzle and thus make the spray current smaller, which when collected by the current sensing element and compared to the set reference current, will send an appropriate signal to control the pump action so that the effect of the regulation over a period of time is a constant spray current. Likewise the control signal may be sent to a programmable power supply that supplies the voltage for generating and maintaining the spray. The details of this close-loop negative feedback control mechanism is well known in the art, and can be implemented with a electronic circuit including a comparator, a signal integrator with a time constant element, or if the time constant is relatively large, directly with a computer with a analog to digital (A/D) input and digital to analog (D/A) output and appropriate software providing the functions of a comparator/integrator circuit.

The amplitude of the spray current is dependent on the liquid sample being sprayed. Samples containing a large quantity of ionizable molecules give a much larger spray current at the same pump rate and applied voltage than samples containing very few such molecules, such as the sample buffers. The reference current used to control the spray must be set according to the samples being sprayed.

While the invention has been particularly shown and described shown and described with reference to preferred embodiments thereof, it will be understood by those skilled in the art that various changes in form and details may be made therein without departing from the spirit and scope of the invention.

What is claimed is:

1. A system for controlling an electrostatically induced liquid spray comprising:

an electrostatic spray device for generating a liquid spray from a liquid sample;

a spray current sensing means placed in relation to the spray device and configured to generate a current output signal that represents a current of the liquid spray;

a mechanism that receives the current output signal and compares it to a pre-selected current value, with a difference between the two representing a control signal tat is sent to one of (1) a pump that regulates the flow rate of the liquid sample and (2) a power supply to regulate an electric field associated with the spray device that generates the liquid spray according to a set level of current; and a mass spectrometer having an inlet for receiving the liquid spray, the current sensing means being disposed between an opening of the spray device though which the liquid spray is discharged and having a ring-shaped structure with an orifice through which the liquid spray passes.

2. The system of claim 1, wherein the electrostatic spray device includes an injection-molded nozzle with an opening of about 20 microns through which the liquid spray is discharged.

3. The system of claim 1, wherein the electrostatic spray device includes a microfabricated nozzle though which the liquid spray is discharged.

4. The system of claim 1, wherein the electrostatic spray device comprises one of an electrode and an electrical conducting element.

5. The system of claim 1, wherein the spray current sensing means comprises one of an electrode disposed proximate but behind a nozzle opening of the spray device and an electrical conducting element placed in front of the spray device.

6. The system of claim 1, wherein the spray current sensing means is disposed proximate but behind an opening of the spray device through which the liquid spray is discharged.

7. The system of claim 1, further comprising:

an inlet associated with a device that receives the liquid spray, wherein the current sensing means is disposed in front of an opening of the spray device though which the liquid spray is discharged, the opening of the spray device being oriented perpendicular to the inlet.

8. The system of claim 7, wherein the inlet is pan of a mass spectrometer.

9. A system for controlling an electrostatically induced liquid spray comprising:

an electrostatic spray device for generating a liquid spray from a liquid sample;

a spray current sensing means placed in relation to the spray device and configured to generate a current output signal that represents a current of the liquid spray;

a mechanism that receives the current output signal and compares it to a pre-selected current value, with a difference between the two representing a control signal that is sent to one of (1) a pump that regulates the flow rate of the liquid sample and (2) a power supply to regulate an electric field associated with the spray device that generates the liquid spray according to a set level of current; and a mass spectrometer having an inlet for receiving the liquid spray, the current sensing means enclosing the inlet and further acting as an electrostatic lens.

10. The system of claim 1, wherein the mechanism includes a current amplifier and a negative feedback element for receiving the current output signal and comparing it to the pre-selected current value for generating the output signal.

11. A method for controlling an electrostatically induced liquid spray comprising the steps of:

generating a liquid spray from a liquid sample with an electrostatic spray device;

providing a mass spectrometer including an inlet that receives the liquid spray;

sensing a current the liquid spray with a spray current sensing disposed between an opening of the spray device, the current sensing means having a ring-shaped structure with an orifice through which the liquid spray passes; through which the liquid spray is discharged and the inlet the liquid spray passing through an opening formed through the current sensing means;

comparing the sensed current of the liquid spray with a pre-selected current value, with a difference between the two representing a control signal; and delivering the control signal to one of (1) a pump that regulates the flow rate of the liquid sample and (2) a power supply to regulate an electric field associated with the spray device according to a set level of current.

* * * * *